US008574091B2

(12) United States Patent
Cameron

(10) Patent No.: US 8,574,091 B2
(45) **Date of Patent: *Nov. 5, 2013**

(54) METHOD AND APPARATUS FOR DETERMINING GOLF BALL PERFORMANCE VERSUS GOLF CLUB CONFIGURATION IN ACCORDANCE WITH A GOLFER'S INDIVIDUAL SWING CHARACTERISTICS

(75) Inventor: Don T. Cameron, Carlsbad, CA (US)

(73) Assignee: Acushnet Company, Fairhaven, MA (US)

( * ) Notice: Subject to any disclaimer, the term of this patent is extended or adjusted under 35 U.S.C. 154(b) by 690 days.

This patent is subject to a terminal disclaimer.

(21) Appl. No.: 12/404,941

(22) Filed: Mar. 16, 2009

(65) Prior Publication Data

US 2009/0221379 A1 Sep. 3, 2009

Related U.S. Application Data

(63) Continuation of application No. 11/192,109, filed on Jul. 29, 2005, now Pat. No. 7,503,858, which is a continuation-in-part of application No. 10/703,541, filed on Nov. 10, 2003, now Pat. No. 7,311,611, which is a continuation of application No. 09/156,540, filed on Sep. 17, 1998, now Pat. No. 6,669,571.

(51) Int. Cl.
*A63B 69/36* (2006.01)
*G06F 19/00* (2011.01)

(52) U.S. Cl.
USPC ..... 473/220; 473/221; 473/269; 700/91

(58) Field of Classification Search
None
See application file for complete search history.

(56) References Cited

U.S. PATENT DOCUMENTS

| | | | | |
|---|---|---|---|---|
| 4,063,259 | A | 12/1977 | Lynch et al. | 354/120 |
| 4,160,942 | A | 7/1979 | Lynch et al. | 350/120 |
| 4,375,887 | A | 3/1983 | Lynch et al. | 273/32 H |
| 4,545,576 | A | 10/1985 | Harris | 273/25 |
| 4,713,686 | A | 12/1987 | Ozaki et al. | 358/107 |
| 4,755,881 | A | 7/1988 | Bartlett | 358/254 |
| 4,860,096 | A | 8/1989 | Long et al. | 358/101 |
| 4,891,748 | A | 1/1990 | Mann | 364/410 |
| 5,111,410 | A | 5/1992 | Nakayama et al. | 364/551.01 |

(Continued)

OTHER PUBLICATIONS

Kodak® Motioncorder Analyzer, Model 1000™ video camera (1996).

(Continued)

*Primary Examiner* — David L Lewis
*Assistant Examiner* — Shauna-Kay Hall
(74) *Attorney, Agent, or Firm* — Smith, Gambrell & Russell, LLP

(57) ABSTRACT

An apparatus and method is provided for analyzing a golfer's individual swing attributes and determining, based on that analysis, a suitable golf club configuration for that golfer. The swing analysis apparatus include video cameras for obtaining video images of a golfer swinging a golf club, such as a putter, at a golf ball. Images obtained from the video cameras may then be analyzed to determine what golf club dimensions will provide improved results in combination with the golfer's individual swing characteristics. The apparatus may additionally include a golf club having predetermined dimensions. When such a golf club is included, images from the video cameras may be analyzed to determine how the golf club of known dimensions must be adjusted to provide the golfer with desirable swing results. The apparatus may also include a method for confirming the dimensions that it is believed will provide a golfer with improve swing results.

18 Claims, 12 Drawing Sheets

(56) References Cited

U.S. PATENT DOCUMENTS

| | | | | | |
|---|---|---|---|---|---|
| 5,154,427 | A | | 10/1992 | Harlan et al. | 273/186.3 |
| 5,184,295 | A | | 2/1993 | Mann | 364/410 |
| 5,210,603 | A | | 5/1993 | Sabin | 358/93 |
| 5,249,967 | A | | 10/1993 | O'Leary et al. | 434/247 |
| 5,297,796 | A | | 3/1994 | Peterson | 273/183.1 |
| 5,333,061 | A | | 7/1994 | Nakashima et al. | 358/335 |
| 5,342,054 | A | | 8/1994 | Chang et al. | 273/186.1 |
| 5,435,562 | A | * | 7/1995 | Stock et al. | 473/220 |
| 5,441,256 | A | | 8/1995 | Hackman | 273/77 A |
| 5,472,205 | A | | 12/1995 | Bouton | 273/187.1 |
| 5,486,001 | A | | 1/1996 | Baker | 273/183.1 |
| 5,501,463 | A | | 3/1996 | Gobush et al. | 273/184 R |
| 5,575,719 | A | | 11/1996 | Gobush et al. | 473/223 |
| 5,591,091 | A | | 1/1997 | Hackman | 473/289 |
| 5,697,791 | A | * | 12/1997 | Nashner et al. | 434/247 |
| 5,707,301 | A | * | 1/1998 | Tollin | 473/257 |
| 5,772,522 | A | | 6/1998 | Nesbit et al. | 473/222 |
| 5,797,805 | A | | 8/1998 | Lubell et al. | 473/266 |
| 5,821,417 | A | | 10/1998 | Naruo et al. | 73/491 |
| 5,823,878 | A | | 10/1998 | Welch | 463/43 |
| 5,827,127 | A | | 10/1998 | Firth | 473/266 |
| 5,833,549 | A | | 11/1998 | Zur et al. | 473/199 |
| 5,864,960 | A | | 2/1999 | DeNicolo et al. | 33/508 |
| 5,911,636 | A | * | 6/1999 | Schmoll | 473/266 |
| 5,951,410 | A | | 9/1999 | Butler et al. | 473/223 |
| 5,984,684 | A | | 11/1999 | Brostedt et al. | 434/252 |
| 6,041,651 | A | | 3/2000 | Naruo et al. | 73/491 |
| 6,095,928 | A | * | 8/2000 | Goszyk | 473/222 |
| 6,565,448 | B2 | | 5/2003 | Cameron et al. | 473/131 |
| 6,669,571 | B1 | | 12/2003 | Cameron et al. | 473/131 |
| 7,311,611 | B2 | | 12/2007 | Cameron et al. | 473/221 |
| 2004/0162154 | A1 | * | 8/2004 | DeJohn | 473/266 |

OTHER PUBLICATIONS

Neat Systems, Inc., The Neat System Never Ending Athletic Trainer CD-Rom, version 3.0 (1996).

* cited by examiner

METHOD AND APPARATUS FOR DETERMINING GOLF BALL PERFORMANCE VERSUS GOLF CLUB CONFIGURATION IN ACCORDANCE WITH A GOLFER'S INDIVIDUAL SWING CHARACTERISTICS

CROSS-REFERENCE TO RELATED APPLICATIONS

The present application is a continuation of U.S. application Ser. No. 11/192,109, filed Jul. 29, 2005, now U.S. Pat. No. 7,503,858, which is a continuation-in-part of U.S. patent application Ser. No. 10/703,541, filed on Nov. 10, 2003 now U.S. Pat. No. 7,311,611, which is a continuation of U.S. patent application Ser. No. 09/156,540, filed on Sep. 17, 1998 and now U.S. Pat. No. 6,669,571. The disclosures of these documents are incorporated herein in their entireties.

COPYRIGHT AUTHORIZATION

A portion of the disclosure of this patent document contains material which is subject to copyright protection. The copyright owner has no objection to the facsimile reproduction by anyone of the patent document or the patent disclosure, as it appears in the Patent and Trademark Office patent files or records, but otherwise reserves all copyrights whatsoever.

BACKGROUND OF THE INVENTION

1. Field of the Invention

The present invention relates generally to equipment used in the game of golf. More particularly, the present invention relates to a method and apparatus for custom fitting a golf club in accordance with a golfer's individual swing characteristics.

2. Description of the Related Art

In recent years, technology relating to the game of golf has evolved rapidly, with many different systems having been implemented for improving the quality of play and the quality of the equipment utilized. For example, U.S. Pat. Nos. 4,375,887 and 4,063,259 disclose methods of analyzing golf ball flight characteristics upon impact with a golf club. Likewise, U.S. Pat. Nos. 5,342,054; 5,697,791; 5,486,001; 5,472,205; 5,249,967; 5,154,427; 5,111,410; and 4,713,686 disclose systems and methods for analyzing a golfer's swing, and providing feedback to the golfer based thereon. U.S. Pat. Nos. 4,063,259 and 4,375,887 disclose techniques for detecting golf club head position, and golf ball position, shortly after impact using photoelectric means to trigger a flash so as to permit a photograph to be taken of the club head. U.S. Pat. Nos. 5,501,463 and 5,575,719 disclose techniques for detecting club head position shortly after impact using cameras capable of receiving light from multiple reflectors placed on the club head prior to the swing.

However, while numerous golf swing analysis, ball trajectory analysis, and club head detection systems have been implemented, there exists a need in the art for a fully satisfactory apparatus and method to review and analyze a golfer's individual swing characteristics, and then configure a golf club in accordance with those characteristics.

SUMMARY OF THE INVENTION

It is therefore an object of the present invention to provide an apparatus and method for analyzing a golfer's individual swing attributes and determining based on that analysis, a suitable golf club configuration for that golfer.

In one exemplary embodiment of the invention, an apparatus is provided that includes a striking location for receiving a golf ball to be struck. The apparatus further includes video camera means, such as high speed video cameras, directed at the striking location for obtaining video images of a golf club during a golfer's swing at the golf ball in the striking area. A means for receiving and storing the video images from the video cameras is also included, along with a means for initiating the storage of video images from the video cameras. A display, such as a computer monitor, is used for displaying the stored video images of the golfer's swing. In addition, a means is included for analyzing the displayed video images of the golfer's swing and determining based on that analysis what golf club dimensions will provide desired results in combination with that golfer's swing.

In yet another exemplary embodiment of the invention, the apparatus additionally includes a golf club, such as a putter, having predetermined dimensions. In this embodiment of the invention, a means is provided for determining, from an analysis of a golfer's swing with the golf club, the amount the dimensions of that golf club must be adjusted to provide the golfer with desirable swing results. Such dimensions would include, for example, the lie and loft of the golf club.

The apparatus may additionally include a means for confirming the club dimensions that are expected to provide a golfer with desired swing results. Means to confirm the appropriate dimensions include an analysis of the performance of a golf ball following impact with the golf club, or an analysis of the golfer's wrist, shoulder, and head movement during the golf swing.

In yet another exemplary embodiment of the invention, a method for configuring a golf club in accordance with an individual golfer's swing is provided. In this embodiment of the invention, a golfer is provided with a golf club of predetermined dimensions, such as a putter. A golf ball is then positioned and aligned in a striking area so that video cameras aimed at the striking area will obtain video images of a golfer's swing while using the golf club. Thereafter, the golfer is instructed to proceed with his or her own golf swing, while at approximately the same time, one or more of the video cameras are activated. Images obtained by the video cameras during the golfer's swing are then captured and stored. From these stored video images, the position of the golf club during the golfer's swing, and the results obtained from that swing, may then be determined. Based on the position of the golf club during the golfer's swing and the results obtained using the golf club of known dimensions, a golf club may then be customized in accordance with that golfer's individual swing characteristics.

DESCRIPTION OF THE DRAWINGS

The present invention is described with reference to the accompanying drawings, in which like reference characters reference like elements, and wherein.

DETAILED DESCRIPTION OF THE INVENTION

The following embodiments of the present invention will be described in the context of golf putters, and the custom fitting of golf putters, although those skilled in the art will recognize that the disclosed methods and structures are readily adaptable for broader application.

Figure 1:
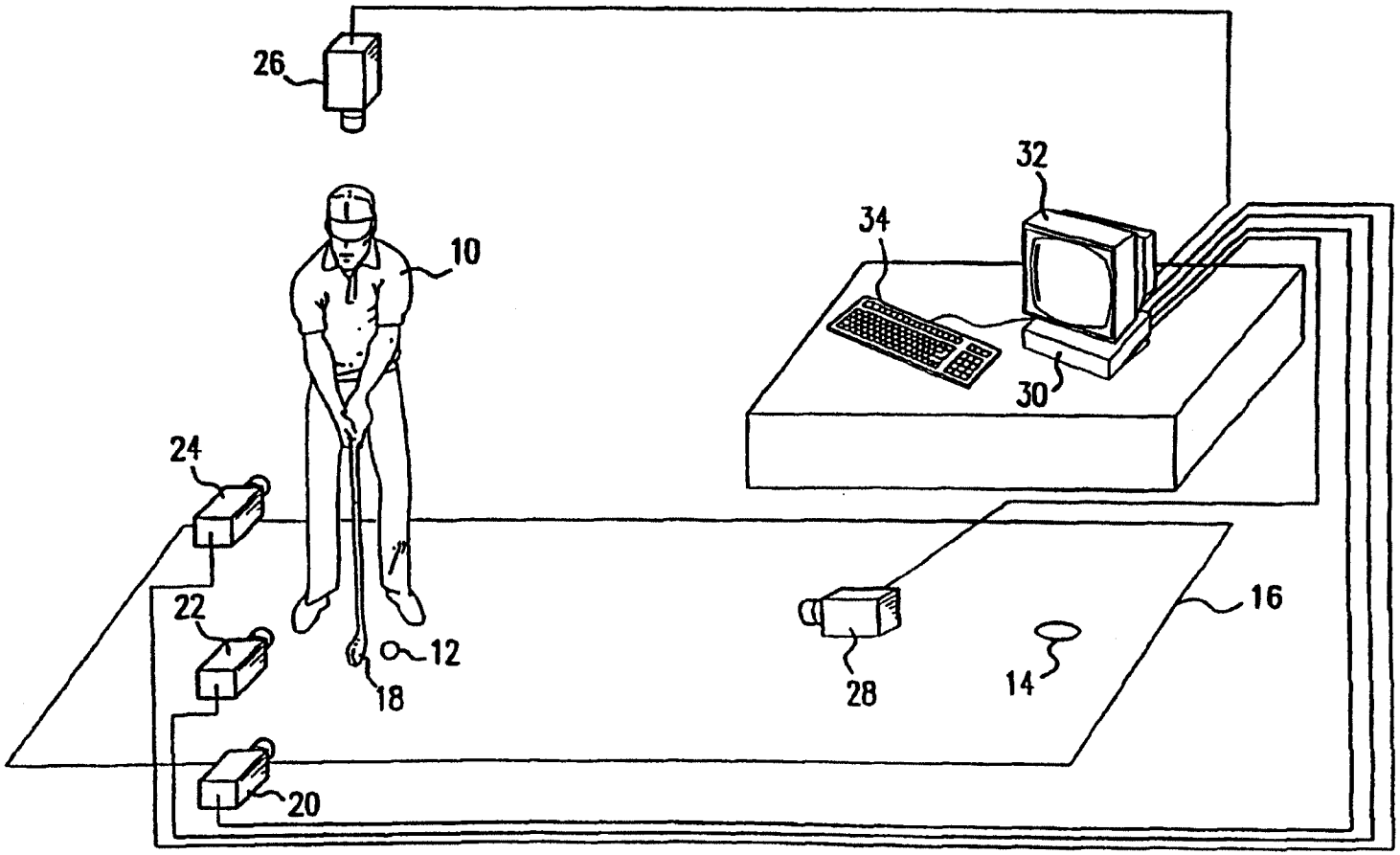
FIG. 1 is a schematic illustration of an apparatus constructed in accordance with the invention.

FIG. 1 discloses a putter analysis system according to one exemplary embodiment of the invention. As shown in FIG. 1, the system includes an artificial putting surface 16 with a hole 14, placed approximately 20 feet from the striking area, for receiving a golf ball 12. The system is suitable for either indoor or outdoor use, and further includes a ball side view camera 20, a shaft side view camera 22, a grip side view camera 24, an overhead view camera 26, and a forward facing camera 28. Each camera is preferably positioned near golfer 10 using any suitable, stable support means, but not so near as to interfere with the golfer's putting stroke. More specifically, ball side view camera 20 is preferably placed at ground level, or as close to ground level as possible, approximately 2-3 feet from golf ball 12 so as to capture close-up side-view images of the putter head and golf ball during the putting stroke. Shaft side view camera 22 may be placed directly above camera 20, approximately 1-2 feet from ground level, so as to obtain side images of the lower half of the golf club shaft during the putting stroke. Grip side view camera 24 is preferably placed directly above cameras 20 and 22, approximately 2-3 feet above ground level, so as to obtain close-up side images of the golfer's grip during the putting stroke. Overhead video camera 26 is mounted directly above the head of golfer 10, approximately 8-10 feet off the ground, so as to obtain images of the golfer's head and golf club swing plane during the putting stroke. Forward facing camera 28 is placed in the golfer's putting line, approximately 12 feet from the golf ball, so as to obtain images that reflect the position of the putter strike face during the putting stroke. Camera 28 should be placed as close to the ground as possible, but no closer than 2 inches, so that a standard 1.68" diameter golf ball will travel unimpeded to hole 14 if positioned beyond camera 28.

Although cameras 20, 22, 24, 26 and 28 may comprise any type of high speed video camera, one suitable camera is the Kodak® Motioncorder Analyzer, Model 1000™ video camera, which can record video images at speeds up to 600 frames per second from the above-referenced locations. While it is to be understood that any number of cameras and camera angles may be employed in accordance with the invention, preferably at least three cameras are employed (in particular, camera 20, camera 22 and camera 28 for better results). The five cameras located in the positions disclosed in FIG. 1 are merely illustrative of a preferred embodiment from which good results have been achieved. Persons of ordinary skill in the art may select the number of cameras and their locations according to desired results based on the teachings of the resent invention. Additionally, if golfer 10 is a left-handed golfer, the positions of cameras 20, 22, and 24 would necessarily be opposite those positions set forth in FIG. 1.

The outputs of video cameras 20, 22, 24, 26, and 28 are connected to a computer 30, which includes an attached monitor 32 and keyboard 34. In one embodiment of the invention, computer 30 is an IBM-compatible personal computer with a Pentium® Processor running at least Windows 95®, and includes a 17" Ultra VGA monitor 32. Depending on the desired means for storing images obtained from video cameras 20, 22, 24, 26, and 28, computer 30 may additionally be attached to a video cassette recorder (VCR), a DVD player, or a CD ROM (read only memory) drive (although neither a VCR, DVD player, nor a CD ROM drive is shown in FIG. 1). In one exemplary embodiment of the invention, however, computer 30 includes a video capture card for converting video images captured from the attached cameras into standard AVI-format data files. These standard AVI-format data files may then be stored on the hard drive of computer 30, or on a CD ROM using an attached CD ROM drive. Although any video capture card may be used, one suitable capture card is the Intel® Smart Video Recorder Board®. If video images are to be captured from only one camera at a time, a video splitter box, such as a Radioshack® video splitter box, may be placed between the five video cameras and computer 30 to accomplish this objective.

Figure 2:
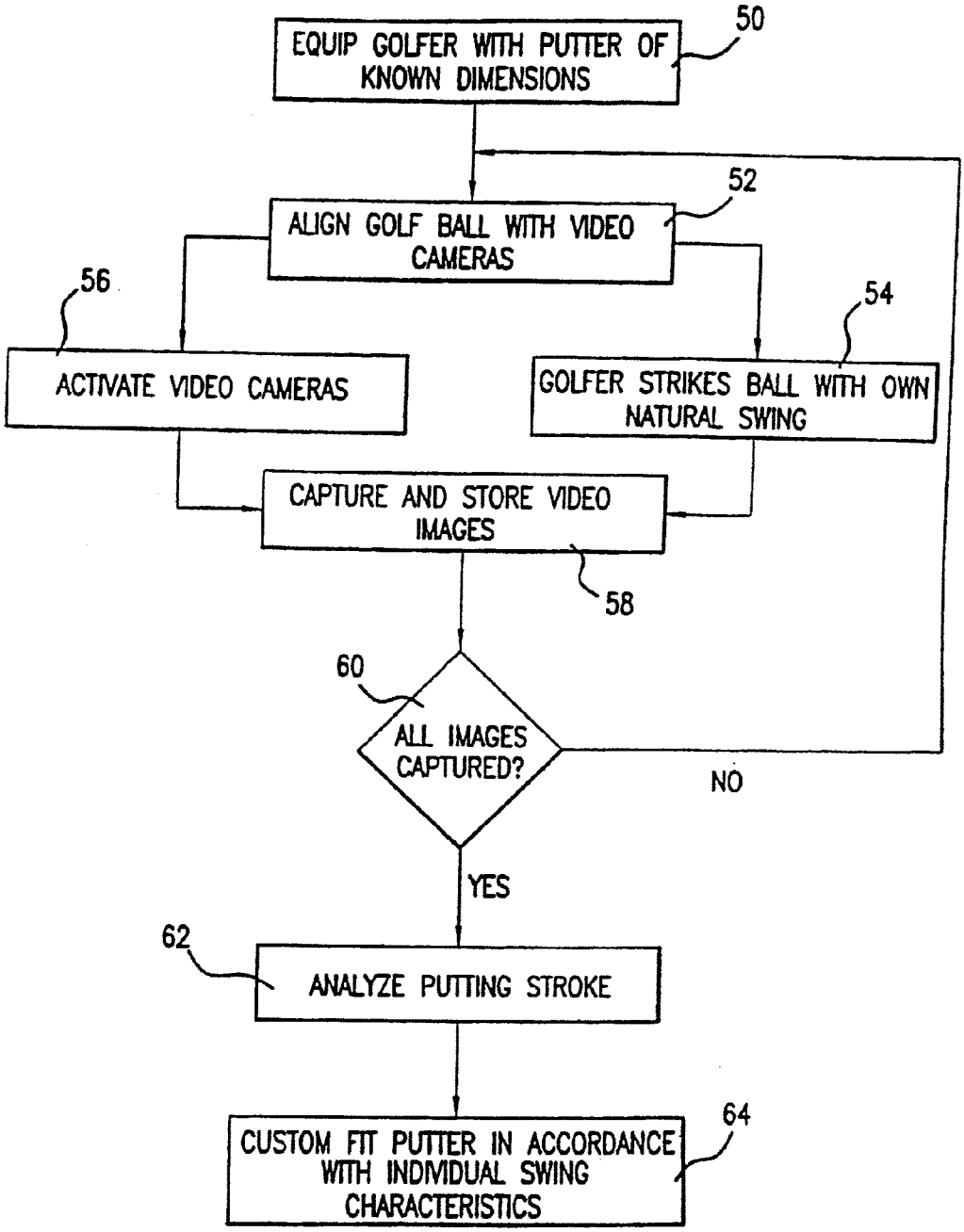
FIG. 2 is a flow chart setting forth an exemplary method of the invention for analyzing a golfer's swing, and custom fitting a golf club in accordance with that swing.
Figure 3B:
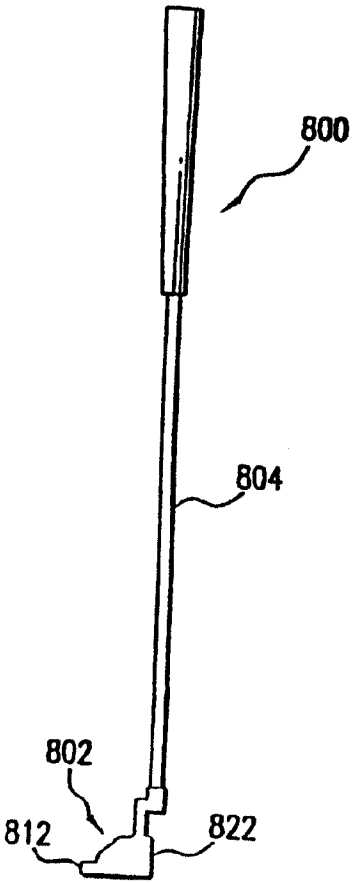
FIGS. 3A-B are, respectively, front and side views of a putter of known dimensions for use with the invention.
Figure 3A:
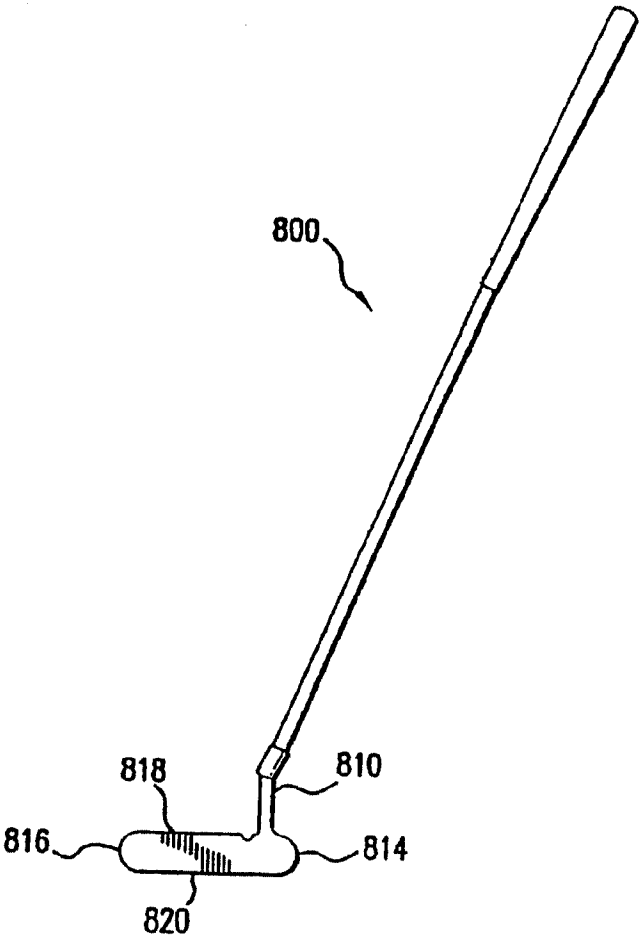

Turning now to FIG. 2, a flow chart is disclosed that sets forth a method, in accordance with the invention, for reviewing and analyzing a golfer's swing, and custom fitting a club (in this example a putter) to that swing. As shown in FIG. 2, a golfer 10 must first be equipped with a putter of known dimensions (step 50). One such putter is that disclosed in FIGS. 3A-B, which contains an exemplary putter head 802. Putter head 802 includes a hosel 810, a back face 812, a heel 814 and toe 816, a top ridge 818, a sole 820, and a front strike face 822. Front strike face 822 is flat, and is set at approximately a 4° loft with respect to a line perpendicular to sole 820. Putter head 802 and shaft 804 are configured such that putter 800 has a 71° lie.

Although golfer 10 may be equipped with any putter of known dimensions, equipping golfer 10 with putter 800 is additionally advantageous, as a putter with such dimensions is generally understood, when used properly, to provide desirable putting results. Accordingly, as is discussed below in detail, if desirable putting results are not obtained during the putting stroke, such information may be used when custom fitting a putter in accordance with the golfer's individual swing characteristics. Thus for example, it has been determined that, if the putter strike face has a 4° loft at impact with a golf ball, the golf ball will be imparted with a generally true roll, allowing the golfer to more easily control the direction of travel of the golf ball and the distance the ball travels. In contrast, if the loft of the putter strike face is less than 4° at impact (due, for example to a particular golfer's forward press which, one skilled in the art will understand, is a situation wherein the golfer allows his grip to travel ahead of the club face during the putting stroke), golf ball 12 may be driven into the putting surface. This causes the golf ball to hop off of the putting surface, resulting in reduced putting accuracy. Similarly, if the putter strike face has greater than a 4° loft at impact (due, for example to a particular golfer's rearward press which, one skilled in the art will understand, is a situation wherein the golfer allows his grip to travel behind the club face during the putting stroke), undesirable backspin may be imparted on golf ball 12, causing golf ball 12 to "check-up" upon contact with the putting surface, again resulting in a loss of putting accuracy. Since putter 800 is configured with a strike face 822 having a 4° loft, if putter 800 is utilized in a standard fashion (imparting no forward or rearward press during the stroke), strike face 822 will have a 4° loft at impact, resulting in desirable putting results. If it is found that strike face 822 does not have a 4° loft at impact (as a result of the golfer's swing), this information may be used, as explained in detail below, to customize a putter to that golfer's swing.

Figure 5:
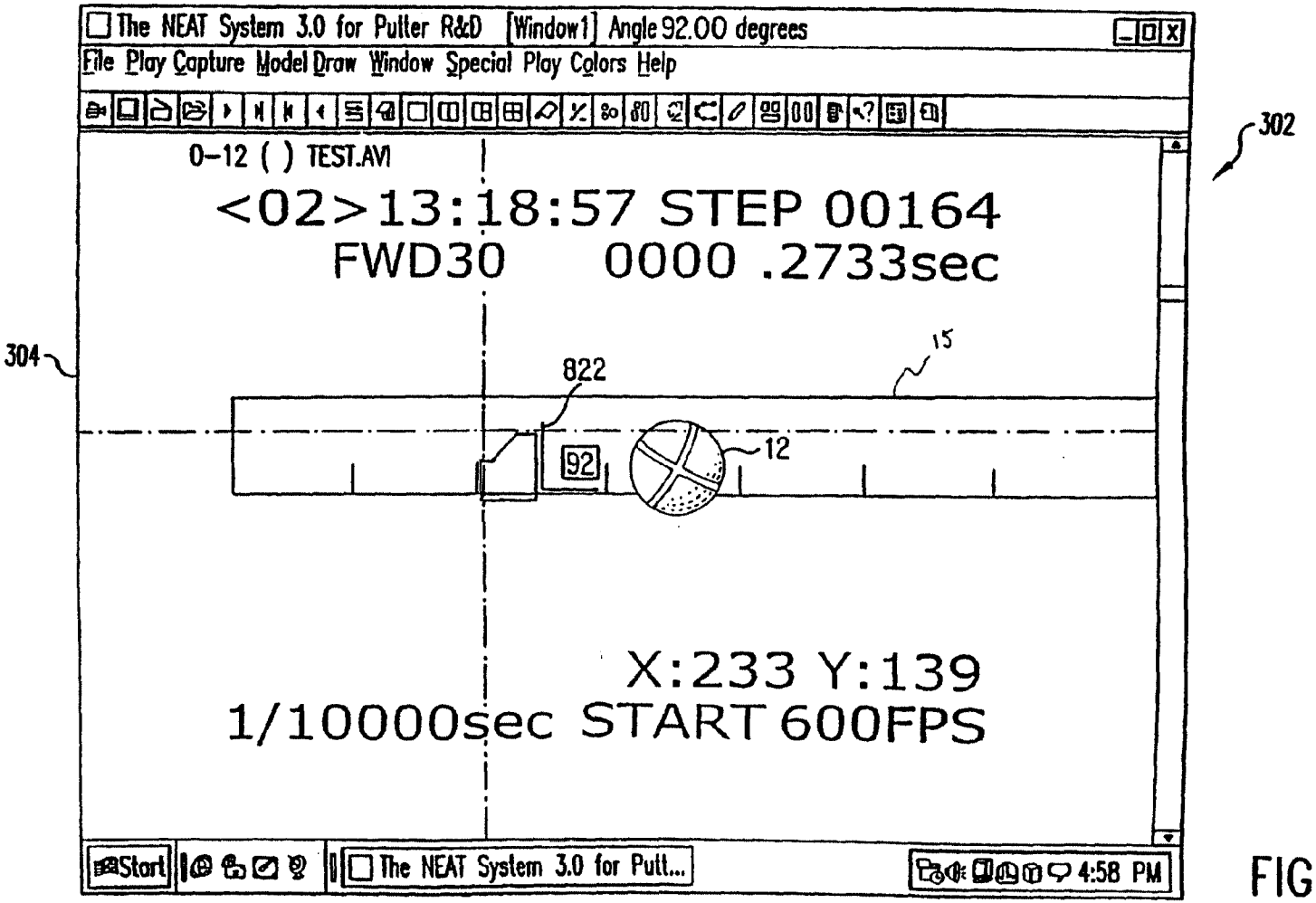
FIG. 5 is a computer display of a ball side view still image illustrating the method according to the present invention.

Once golfer 10 has been fitted with a golf club of known dimensions, golf ball 12 must be placed at a location on putting surface 16 (the striking area) that is within view of video camera 20 (step 52). As shown in FIG. 5 for example, dark-colored bands may be advantageously placed along two perpendicular circumferences of golf ball 12 prior to its placement in the striking area, allowing for more accurate analysis of golf ball movement following impact with the putter. Specifically, with dark-colored bands placed on golf ball 12, it is much easier, given the limitations on the quality of captured video images, to analyze the movement imparted on golf ball 12 once it is struck.

Once golf ball 12 is properly positioned with respect to cameras 20, 22, 24, 26, and 28, golfer 10 putts the ball with his or her own natural putting stroke (step 54). At approximately the same time golfer 10 initiates his or her putting stroke, or immediately before that time, one or more of the video cameras 20, 22, 24, 26, and 28 are activated (step 56). As is discussed in more detail below, activation of the video cameras may be accomplished manually by the system operator, or may be accomplished through a software routine in computer 30.

As is also discussed in more detail below, during the golfer's putting stroke, video images from the activated cameras are captured and stored using the video capture card and storage means of computer 30 (step 58). If video images from additional putting strokes are to be captured, or if video images from only one camera at a time are to be captured, golfer 10 may be instructed to proceed with additional putting strokes (step 60). However, if images are only being obtained from one camera at a time, the selection means on the video splitter box must be adjusted so that computer 30 will receive signals from the desired video camera before each successive putting stroke.

Once all desired images from the video cameras have been captured and stored digitally in data files, the golfer's putting stroke must then be analyzed (step 62). To facilitate this analysis, a sports training software system may be employed. One exemplary embodiment of a sports training software system is a modified version of the NEAT System 3.0—Never Ending Athletic Trainer™, available from Neat Systems, Inc., 133 Defense Highway, Suite 109, Annapolis, Md. 21401. As discussed below, the NEAT System 3.0 is modified, in accordance with the invention, to include both a detailed angular read-out for the system operator and the ability to be linked to multiple cameras (as opposed to single camera). It is to be understood, however, that although sports training software system is described using as an example NEAT System 3.0, any method or apparatus for graphically displaying and analyzing a golfer's stroke in accordance with the invention may be employed.

FIGS. 4-8 illustrate an exemplary embodiment of a graphical user interface 302 for the sports training software system. As shown in FIG. 4-8, user interface 302 includes a video-image screen 304. Video-image screen 304 allows the user to view and analyze images captured from cameras 20, 22, 24, 26, and 28 using various functions of the putting analysis system relating to the display and analysis of a putting stroke. User interface 302 enables the user to select from and utilize these functions, functions which include capture video 310, review capture video 312, open video 314, forward play 316, forward step 318, reverse play 320, reverse step 322, window number 324, line 326, circle 328, rectangle 330, and angle 332. For clarification, the graphic buttons in user interface 302 that correspond to these various functions have been labeled with the matching function numbers in FIG. 4.

As mentioned, before the video images are to be analyzed, they must first be captured (step 58 in FIG. 2). This may be done using capture video 310 function. When the capture video button is depressed (button 310 in FIG. 4), the user interface of modified NEAT System will allow the user to select from one of the five available video cameras. Once a video camera is selected, the video camera may be controlled using the sports training software system. Specifically, NEAT System 3.0 can be modified to allow the user to control from the user interface the functions of the cameras being used. In the case of the Kodak® Motioncorder Analyzer, Model 1000™, these functions include trigger, mode, playback direction, stop/escape, and shutter speed/frame rate. By controlling the cameras from user interface 302, the system operator can capture a video image without leaving computer 30, and without having to manually control the video cameras from the video camera positions. These captured images may then stored as a data file using the video capture card of computer 30. If the user wishes to review the captured images prior to permanent storage on the hard drive of computer 30, or on a CD ROM, review capture file 312 function may be used (by depressing button 312 in FIG. 4) to play the captured video images back in real time.

Once all desired images have been captured and stored, a particular image to be reviewed and analyzed may be opened into video-image screen 304 using open video function 314 (by depressing button 314). Once selected, open video function 314 prompts the system operator for the file name and file path of the video-image file to be analyzed.

Once a video-image file is opened, various functions of the software system may be utilized to manipulate and analyze the video images. For example, if forward play 318 function is selected by depressing button 318, the opened video image will play back at normal, real-time speed in screen 304. If reverse play 320 function is chosen, the opened video image will play back in reverse at normal, real-time speed. If the user selects the forward step 320 or reverse step 324 functions, the captured video images will proceed in either forward or reverse fashion one frame at a time in screen 304. This sequential procession of frames is controlled by the user through buttons 320 and 324 in FIG. 4; each time these buttons are depressed, the video proceeds forward (or backward) one step or frame, which is equivalent, for example, to 0.00167 seconds if a 600 frame per second camera is being utilized. Using these functions, the user can advance to and then stop at any specific phase of the golfer's swing for more detailed analysis. Two appropriate stopping points for such an analysis are at the point of ball/club impact, or immediately thereafter.

Figure 4:
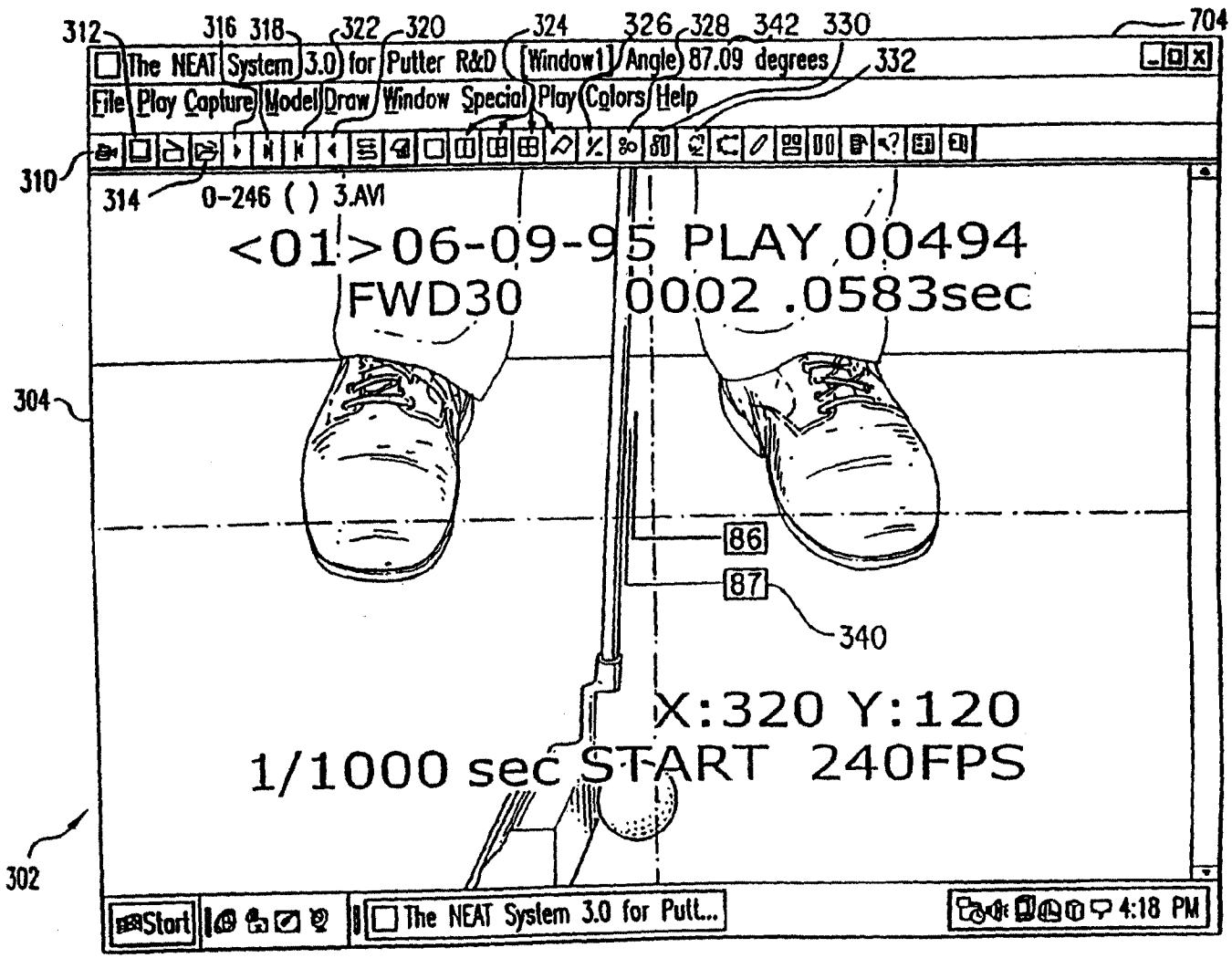
FIG. 4 is a computer display of a shaft side view still image illustrating the method according to the present invention.

An exemplary video image, wherein such an appropriate stopping point has been reached, is disclosed in screen 304 of FIG. 4. Specifically, screen 304 of FIG. 4 includes a shaft side view still image, previously captured from camera 22, obtained at the time the golf club impacts the ball. Once such an advantageous stopping point is reached, additional functions of the system may be used to analyze the golfer's putting stroke. This detailed analysis using additional system functions will now be described in the context of FIG. 4-8.

As mentioned, FIG. 4 illustrates a shaft side view video image obtained at the time the golf club impacts the ball. Using angle function 332, the angle of the club shaft upon the putter's impact with the ball may be determined from this still image. In general, angle function 332 allows the user to draw two lines over image screen 304, said two lines connecting to form a vertex. The system will then compute and display the precise angle formed between these two lines.

Accordingly, to determine the club shaft angle at impact, the user first draws a line along the club shaft, and then connects to that line a horizontal line representing the putting surface. The putting analysis system will then compute and display the angle between these two lines, which represents the club shaft angle at impact with the ball. An example of two such lines, and the resulting angular read-out 340 (87 degrees in FIG. 4), can be seen in video image screen 304 of FIG. 4. In accordance with one previously-described modification to NEAT System 3.0, this angular reading is also displayed to two-decimal place accuracy (87.09 degrees in FIG. 4), at a second position 342 on the computer screen.

Using the obtained angular reading, it may be determined whether golfer 10 has a forward or rearward press of the putter at impact, and if so, the extent of the press. Thus, for example, if the obtained angular reading is 87°, as shown in FIG. 4, this would indicate that the golfer has a 3° forward press. This information may then be used to custom-fit a putter to that golfer's putting stroke (step 64 in FIG. 2). Specifically, if golfer 10 has a forward press upon impact with the ball, he or she is de-lofting the putter strike face 822 from its original, desired 4° angle. Accordingly, the strike face of golfer 10's putter should be additionally lofted by the amount of forward press imparted by golfer 10 on the putter during the putting stroke. So, for example, if golfer 10 has a 3° forward press at impact with the golf ball, his or her putter should be customized to include a strike face with a 7° loft. It is known that golfer 10 will de-loft the 7° strike face by three degrees, resulting in the desired 4° loft at impact with the ball. Similarly, if golfer 10 has a rearward press, he or she is lofting the putter face from its original, desired 4° angle. Accordingly, the face of golfer 10's putter should be de-lofted by the amount of rearward press imparted by golfer 10. For example, if golfer 10 has a 3° rearward press at impact with the golf ball, his or her putter should be customized to include a strike face with a 1° loft. It is known that golfer 10 will loft the 10 strike face by three degrees, resulting in the desired 4° loft at impact with the ball.

An 86° angle is additionally disclosed in FIG. 4. This angle was drawn to correspond to the angle of the putter shaft just prior to initiation of the putter stroke, and allows a golfer to compare the position of his putter just prior to swing initiation with the position of his putter at impact with the golf ball. Such a comparison is advantageous as it allows the golfer, for example, to determine whether his wrists are hinging during the putting stroke. If the angular reading prior to the putting stroke differs from that obtained at impact with the golf ball, this would tend to indicate that a certain amount of wrist movement is occurring.

One skilled in the art will understand that although angle function 332 has been described in the context of a manually drawn angle, a software routine can be easily implemented to automate angle function 332. For example, the system can be programmed to automatically recognize, upon command, the putter shaft (either by color, shape, or by distinct markings placed at various predetermined locations on the shaft), and to determine the angle between the shaft and a horizontal plane. By automating angle function 332 in this fashion, any potential error introduced by the system operator in drawing the angle will be eliminated.

Screen 304 of FIG. 5 includes a ball side view still image, previously captured from camera 20, obtained immediately after the golf club has impacted the ball. By viewing ball side view images immediately following the point of club/ball impact (by for example forward step function 318), additional information may be obtained regarding the putting stroke of golfer 10. For example, by analyzing the performance of golf ball 12 once struck, it may be determined whether golfer 10 is "slicing" or "drawing" the golf ball. It may also be determined whether the golfer is properly keeping the club face square through impact or, alternatively, whether the golfer is opening or closing the club face through impact.

For a right handed golfer, "slicing" refers to those situations wherein the ball is imparted with a clockwise rotation, when viewed from the golfer's perspective, upon impact (for a left handed golfer, it would be a counter clockwise rotation). A sliced putt may result when the putting stroke starts outside the proper swing plane, and then proceeds to move towards the inside of the swing plane upon impact with golf ball 12 (keeping the hands too "still" through impact may also result in, or exacerbate, a sliced shot). For a right handed golfer, "drawing" refers to those situations wherein the ball is imparted with a counter-clockwise rotation, when viewed from the golfer's perspective, upon impact (for a left handed golfer, it would be a clockwise rotation). A drawn putt may result when the putting stroke starts inside the proper swing plane, and then proceeds to move towards the outside of the swing plane upon impact with the golf ball (over aggressive hand movement while closing the club face at impact may also result in, or exacerbate, a drawn shot). Slicing or drawing of the golf ball during the putting stroke is undesirable, as it results in a loss of putting accuracy, both in terms of direction and in terms of distance. A failure to keep the club face square through impact is undesirable for these same reasons.

Once it has been determined whether golfer 10 is slicing or drawing the golf ball when putting, and to what extent, or whether a golfer is keeping the club face square through impact, this information may be used to customize the putter of golfer 10 in accordance with his or her individual swing characteristics. Specifically, if golfer 10 is slicing the ball or keeping the clubface open through impact, his or her putter should be configured with more "offset". Offset refers to a putter configuration wherein the strikeface is set back (or forward as the case may be) of the putter shaft. By offsetting the strike face back or rearward of the putter shaft in an exaggerated fashion, the golfer is provided with more time to square the club face prior to impact with the golf ball, thus reducing the amount of slice imparted on the golf ball.

Alternatively, if golfer 10 is drawing the golf ball or keeping the clubface closed through impact, the golf club should be configured with less offset, or no offset, so as to give the golfer less time to square the club face at impact, thus reducing the amount of draw imparted on the golf ball.

Ball side view still image of FIG. 5, obtained immediately after the golf club has impacted the ball, may also be used to confirm the angular measurements obtained in conjunction with the shaft side view still image of FIG. 4. Using angle function 332 in the same fashion as described in the context of FIG. 4, the angle of strike face 822 at impact with the golf ball may be determined. The 92° angle shown in FIG. 5, for example, confirms that golfer 10 is forward pressing the putter by 2°, as a model 4° angle of the club face at impact would result in an angular reading, taken from the strike face, of 94°.

Ball side view moving images following impact may also be used to confirm whether an appropriate loft of the putter strike face exists at impact. For example, it has been determined that for a 20 foot putt, the golf ball should preferably travel through the air, with no backspin, for approximately 9 inches when properly struck. If the ball is traveling through the air for more than 9 inches, with backspin, this tends to indicate that putter strike face 822 is too lofted at impact with the golf ball. If the ball travels less than 9 inches through the air, with immediate forward spin, this tends to indicate that the putter strike face 822 is not lofted enough at impact. In this fashion, the system operator can further confirm the status of the putter strike face at impact with golf ball 12.

The ball side view image of FIG. 5 also shows a rail 15. The rail 15 may be included to provide a background against which the ball 12 may be more easily viewed. It is preferably positioned on the striking location so as to be intermediate the golfer's feet and the ball 12. Preferably, the rail 15 includes measurement indicia thereon to provide another means of measuring the golf swing and the golf ball performance.

Figure 6:
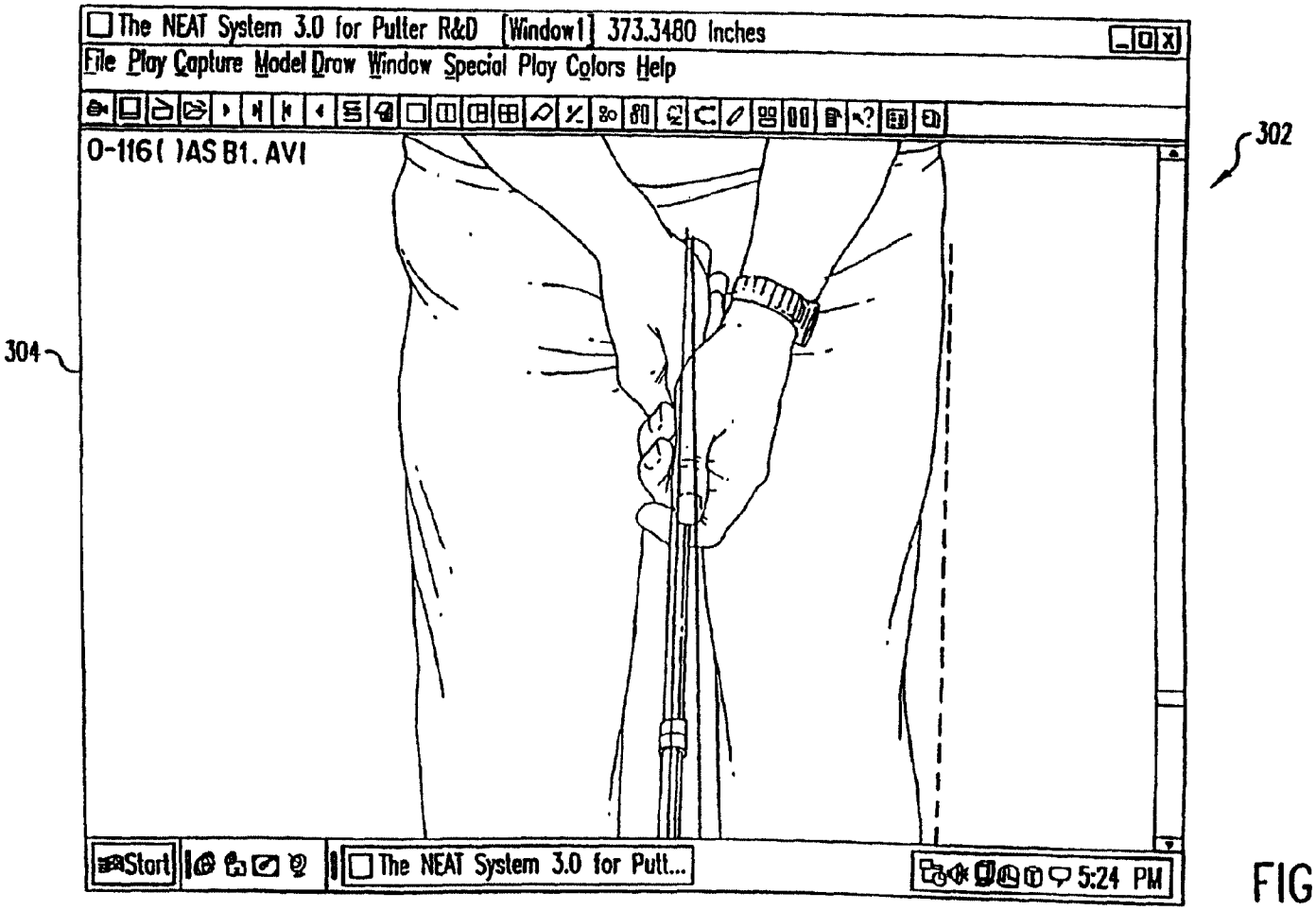
FIG. 6 is a computer display of a putter grip side view still image illustrating the method according to the present invention.

Screen 304 of FIG. 6 includes a putter grip side view still image, previously captured from camera 24, obtained immediately after the golf club has impacted the ball. By viewing putter grip side view images immediately prior to and then following the point of club/ball impact (by for example forward step function 318), it may be determined whether the wrists of golfer 10 are remaining still through impact, as is preferred, or whether the wrists are "breaking down" through impact. A "breaking down" of the wrists during the putting stroke refers to those instances wherein movement occurs at the wrist joints of golfer 10. It is well recognized that the desired putting stroke employs a back-and-forth pendulum movement largely at the shoulders, with no hinging or movement of the wrists during the putting stroke. If the wrists are moving, or "breaking down", during the stroke, this may disadvantageously result in a backward press of the strike face (if the wrists are used to move the club face forward of the golfer's hands prior to impact) or a forward press of the strike face (if the wrists hinge so as to allow the club face to drag behind the golfer's hands prior to impact). Using putter grip side view images to determine whether the wrists are breaking down, and if so, in what fashion, enables the user of the system to further confirm the angular readings obtained from the shaft and ball side view images of FIGS. 4 and 5, and to potentially pinpoint for the golfer the reason for those angular readings. So, for example, if it is determined from the angular readings off the shaft and strike face that golfer 10 has a two degree forward press, and then using the grip side view images, it is determined that the golfer is allowing the putter head to drag behind his hands by letting his wrists hinge, the findings from the angular readings have been confirmed and the cause of the forward press has been determined.

By viewing putter grip side view images immediately prior to and then following the point of club/ball impact (by for example forward step function 318), it may also be determined whether golfer 10 is leaning one way or the other (in other words, placing too much weight on one foot or the other) during the putting stroke. If golfer 10 is leaning toward the target during the stroke (i.e., placing too much weight on his left leg), this may disadvantageously result in a forward press of the strike face due to the steeper angle of attack imparted by the golfer's forward lean. If golfer 10 is leaning away from the target during the stroke (i.e., placing too much weight on his right, rear leg), this may disadvantageously result in a backward press of the strike face due to the more shallow angle of attack imparted by the golfer's rearward lean. Using putter grip side view images to determine whether the golfer is leaning, and if so, in what fashion, enables the user of the system to further confirm the angular readings obtained from the shaft and ball side view images of FIGS. 3 and 4, and to potentially pinpoint for the golfer the reason for those angular readings. So, for example, if it is determined from the angular readings off the shaft and strike face that golfer 10 has a two degree forward press, and then using the grip side view images, it is determined that although the golfer's wrists are remaining still, golfer 10 is leaning forward on his left leg, the findings from the angular readings have been confirmed and the cause of the forward press has been determined.

To more accurately measure the dynamic location of the golfer's center of weight during the swing, and to facilitate the expression of this information to the golfer, a force plate preferably is used. The force plate is positioned under the striking location such that the golfer will stand atop if when addressing the golf ball. The force plate is sensitive to weight and can determine the effective concentration or center of the weight placed thereon. In one embodiment, the force plate is a OR6-7™ Force Platform, available from Advanced Mechanical Technology, Inc.™, 176 Waltham Street, Watertown, Mass. 02472. The force plate measures the golfer's center of weight during the swing. The force plate is operatively coupled to the computer to transmit measured center of weight data for analysis and display. A preferred display type is a trace display. This advantageously allows the golfer's center of weight to be graphically displayed in a manner that facilitates understanding and interpretation of the data. The force plate and golfer center of weight are discussed in more detail below.

Figure 7:
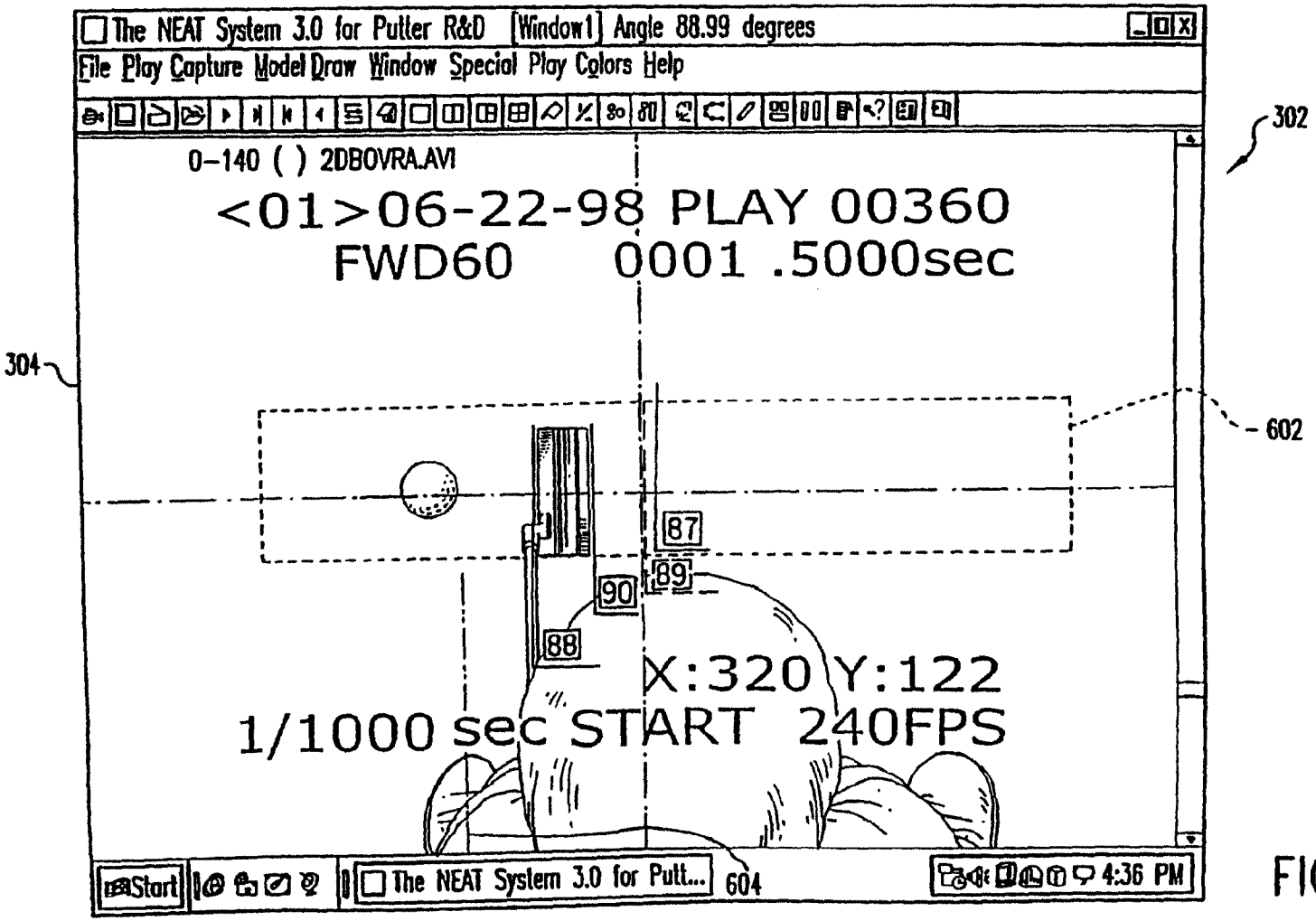
FIG. 7 is a computer display of an overhead view still image illustrating the method according to the present invention.

Screen 304 of FIG. 7 includes an overhead view still image, previously captured from camera 26, obtained immediately after the golf club has impacted the ball. By viewing overhead view images immediately prior to and then following the point of club/ball impact (using for example forward step function 318), it may be determined whether golfer 10 is tracking the putter on the appropriate swing plane or line.

More particularly, using rectangle function 330 and angle function 332 of the system, a rectangle 602 may be drawn around the putter head with a rectangle width approximately corresponding to the length of the putter head, and with a rectangle length approximately corresponding to the length of the putting stroke. By stepping through the putting stroke (using forward step function 318 and reverse step function 322) while rectangle 602 is superimposed over screen 304, and by drawing angles corresponding to the putter face at various intervals within the stroke (see, for example, the exemplary angles—87°, 89°, 90°, and 88°—set forth in FIG. 7), it may be determined if golfer 10 is keeping the golf club on the appropriate swing plane, or alternatively, if golfer 10 is going inside or outside that swing plane. If golfer 10 is taking the putter inside the appropriate swing plane on his back swing, golfer 10 is likely either to keep the putter face open at impact (resulting in a putt that will miss to the right), or to draw the golf ball upon impact (resulting in inaccurate putting direction and distance). If golfer 10 is taking the putter outside the appropriate swing plane on his back swing, golfer 10 is likely either to keep the putter face closed at impact (resulting in a putt that will miss to the left), or to slice the golf ball upon impact (resulting in inaccurate putting direction and distance).

Once it has been determined whether golfer 10 is deviating from the appropriate swing plane, this information may be used to customize a putter for golfer 10 in accordance with his or her individual swing characteristics. Specifically, if golfer 10 is bringing the golf club outside the appropriate swing plane during the backstroke, his or her putter should be configured with more "offset" for those reasons previously discussed. Alternatively, if golfer 10 is bringing the putter inside the appropriate swing plane during the backstroke, the golf club should be configured with less offset or no offset, also for those reasons previously discussed.

Overhead view image of FIG. 7 may also be used to determine the amount of head movement golfer 10 has during his or her putting stroke. Using line function 326 (by depressing button 326 in FIG. 4), a line 604 may be drawn along the left edge of golfer 10's head just prior to the start of his or her putting stroke. The putting stroke may then be stepped through, frame by frame, until the point in the putting stroke has been reached where the club head contacts the golf ball. Line function 326 may then be used to measure the distance, if any, the left edge of golfer 10's head has moved from its initial position. Lines, rectangles, dots, etc. may similarly be used for other functions. For example, the golfer's hand position at address can be marked and the mark(s) compared to the golfer's hand position at impact.

It must additionally be noted that, because the system has no way of knowing the actual distance between points in screen 304 (because golfer 10 and the putter are not reproduced to scale on the screen), distances must first be calibrated. To do this, a line is drawn between two points, between which the distance is known (for example, the diameter of the ball, which is known to be 1.68 inches). The system is then instructed by the system operator as to what distance that is. Using this calibration, any line can be drawn on the screen using line function 326, the distance of which the system will now be able to compute (although this distance will not be the exact distance, given the fact that the golf ball, against which the distance is calibrated, appears smaller on the screen than the golfer's head, as it is farther away from the video camera). In this fashion, it can be determined just how far the golfer's head is moving during the putting stroke.

If golfer 10 is moving his or her head backward (or forward) more than 1½ inches during the stroke, the head movement will in most cases cause the putter club head to lift off the ground, resulting in a steeper angle of attack and a de-lofted strike face at impact. This information can be used to further confirm the results of the angular readings from the shaft and strike face (discussed in conjunction with FIGS. 3 and 4), and to allow the system operator to pinpoint the reason why golfer 10 has de-lofted the club at impact. This information can also be used to confirm the weight concentration data mentioned above.

It must additionally be noted that circle function 328 may be used, in the place of line function 326, to compute the distance a golfer's head moves during the putting stroke. Using circle function 328 (by depressing button 328 in FIG. 4), a circle may be drawn around golfer 10's head just prior to the start of his or her putting stroke. The putting stroke may then be stepped through, frame by frame, until the point in the putting stroke has been reached where the putter head contacts the golf ball. Line function 326 may then be used to measure the distance from one side of the golfer's head to the point on the circle representing the position where that same side was at the initiation of the putting stroke.

Figure 8:
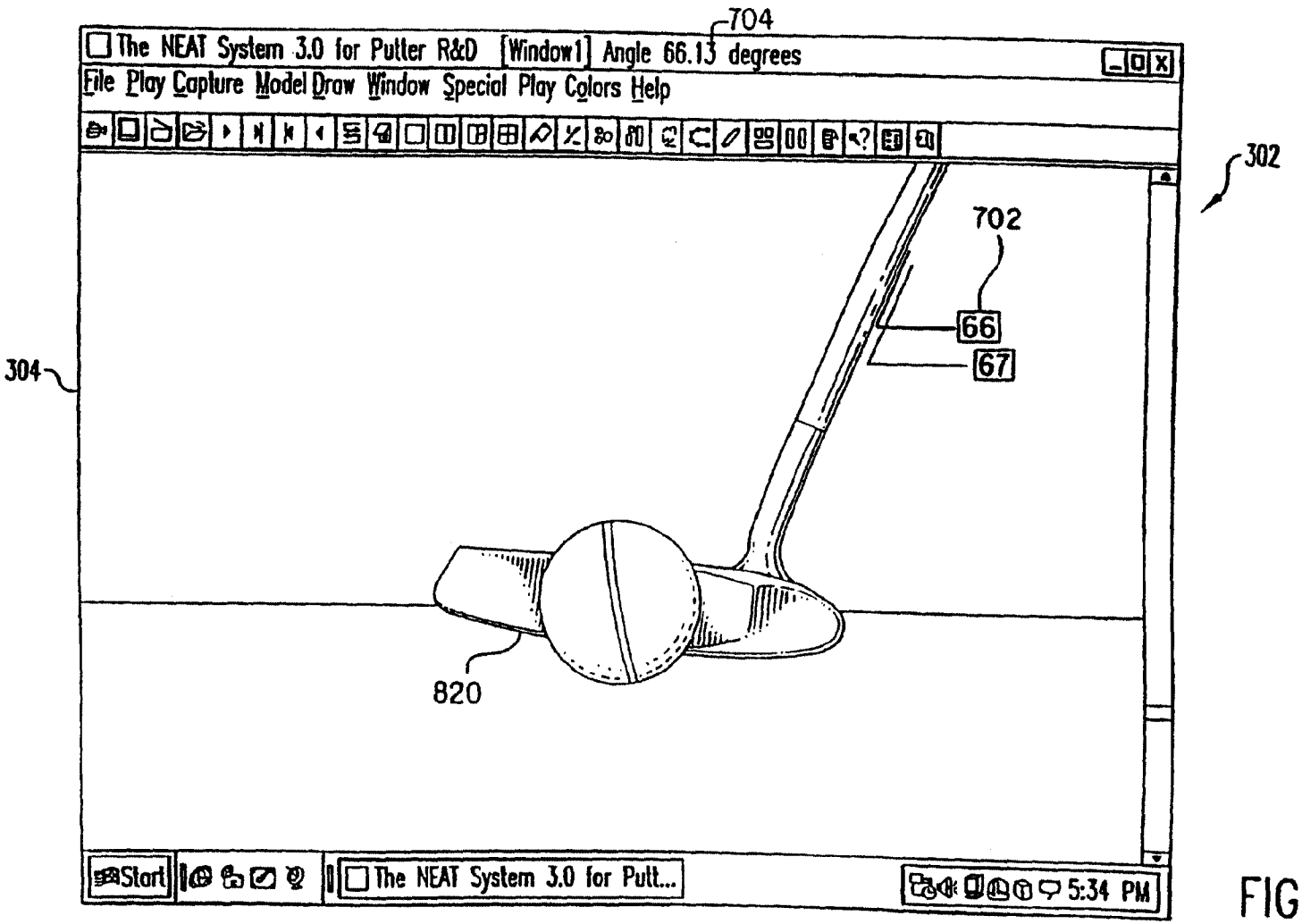
FIG. 8 is a computer display of a forward facing view still image illustrating the method according to the present invention.

Screen 304 of FIG. 8 includes a forward facing view still image, previously captured from camera 28, obtained immediately after the golf club has impacted the ball. Using angle function 332, the angle of sole 820 upon the putter's impact with the ball may be determined from this still image. As mentioned, angle function 332 allows the user to draw two lines over image screen 304, said two lines connecting to form a vertex. The system will then compute the precise angle formed between these two lines. Accordingly, to determine the sole angle at impact, the user first draws a line along the shaft of the putter, and then connects to that line a horizontal line representing the putting surface. The putting analysis system will then compute and display the angle between these two lines, which represents the shaft angle at impact with the ball. An example of two such lines, and the resulting angular read-out 702 (66 degrees in FIG. 8), can be seen in video image screen 304 of FIG. 8. This angular reading is also displayed to two-decimal place accuracy (66.13 degrees in FIG. 8), at a second position 704 on the computer screen. This shaft angle (66 degrees in FIG. 8) may then be compared to the shaft angle when the sole is parallel to the putting surface (generally 71 degrees) to determine the putter sole angle at impact, which in this example would be 5 degrees.

More specifically, using the obtained angular reading from the putter shaft, it may be determined whether the lie of the putter with known dimensions is too upright or too flat for golfer 10's individual swing characteristics. As mentioned, the common lie angle for a putter is 71 degrees. If, however, it is determined from angular read-outs 702 and 704 that golfer 10 is striking the ball with the toe of the putter 5° from horizontal (that is, the toe is above the heel at a 5° angle from horizontal as shown in FIG. 8), then the putter of golfer 10 may be customized to include a 66° lie. Similarly, if it is determined from angular read-outs 702 and 704 that golfer 10 is striking the ball with the heel of the putter 5° from horizontal (that is, the heel is above the toe at a 5° angle from horizontal), then the putter of golfer 10 may be customized to include a 76° lie.

Figure 9:
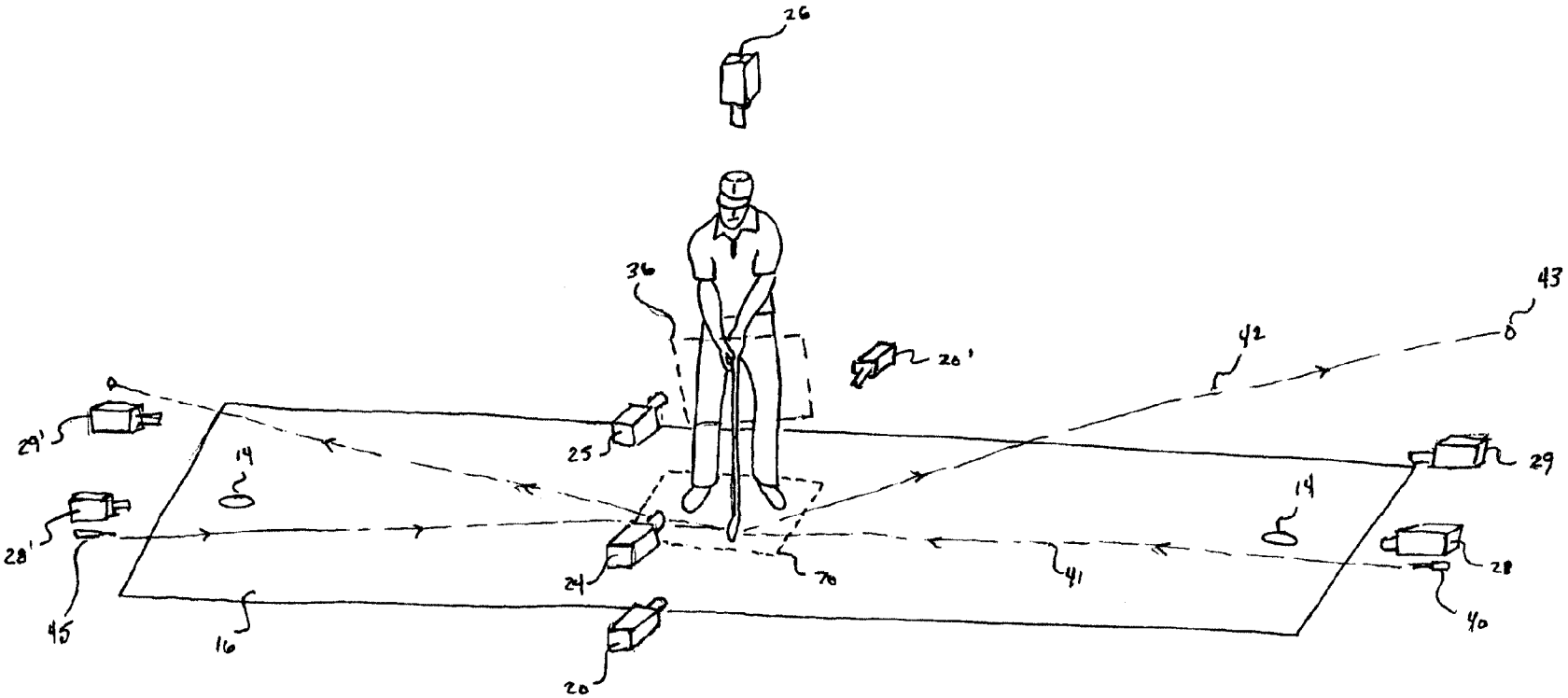
FIG. 9 is a schematic illustration of an apparatus constructed in accordance with the invention.

FIG. 9 is a schematic illustration of a golf analysis system constructed in accordance with the invention. Many of the components discussed with respect to the system illustrated in FIG. 1 are also present in the system of FIG. 9 and are identified with the same reference numbers. The apparatus of FIG. 9, however, also includes additional equipment. The system includes an artificial putting surface 16. To facilitate analysis of both right- and left-handed golf swings, two holes 14 are included. Both right- and left-handed golfers face the same direction when using the system, so the operator is not required to reposition the equipment or reconfigure the system. The holes 14 are placed a suitable distance from the striking area. For example, the holes 14 may be placed approximately 20 feet from the striking area. Similarly to the previously discussed embodiment, the system includes a ball side view camera 20, a grip side view camera 24, an overhead view camera 26, and a forward facing camera 28. The system may optionally include a shaft side view camera 22, though none is illustrated in FIG. 9. The system further includes a shoulder side view camera 25 and shoulder forward facing camera 29. As previously discussed, it is well recognized that the desired putting stroke employs a back-and-forth pendulum movement largely at the shoulders, with no hinging or movement of the wrists during the putting stroke. The addition of shoulder cameras 25, 29 allow the rotational and translational movement of the golfer's shoulders to be captured, analyzed, and displayed, providing the golfer with a more complete understanding of his golf swing. Shoulder side view camera 25 preferably is placed directly above the other side view cameras, and shoulder forward facing camera 29 preferably is placed directly above the forward facing camera 28. A rear camera 21' is placed behind the golfer to provide rear views of the golfer and equipment. Additional cameras 28', 29' are placed opposite the forward facing cameras 28, 29 to capture images from the backswing side of the right-handed golfer shown in FIG. 9, or forward facing images of a left-handed golfer. Though not shown in FIG. 9, the system further includes a computer, to which the cameras are operatively coupled, and user controls.

The system further includes a laser device 40. The laser device 40 is positioned in front of the golfer in an extension of the intended putting line between the striking location area of the surface 16 and the hole 14. The laser device 40 projects a laser beam at the striking location. When used during a golf swing, the laser device 40 can illuminate the desired putt path.

As discussed above, it is important for a golfer to square the club head at impact. The laser device 40 provides a useful tool for measuring club head squareness. The laser device 40 can be activated to project a laser beam 41 at the striking location. Without a ball in place, the laser beam 41 will strike the golf club head. If the golf club head is provided with a reflective surface, the laser beam 41 will reflect backward toward the laser device 40. If the club head is properly squared, the reflected laser beam 42 will impact a predetermined location 43. This predetermined location 43 can be identified in any convenient manner. If the club head is not in the proper position, the reflected beam 42 will not impact the predetermined location 43. The golfer will thus be provided with instant feedback as to which direction the club head is facing. For example, if the predetermined location is positioned 25 feet from the striking location, a 1° closed or opened club head position will result in the reflected beam 42 moving approximately 5.25 inches from the predetermined position 43. Similarly, if the golfer has a 1° rearward press such that the effective loft angle is 5°, the reflected beam 42 will be approximately 5.27 inches above the predetermined position 43. Thus, even slight deviations from the squared position will be readily discernible via the laser device 40. Laser device 40 may also be used during a golfer's swing to dynamically illuminate the orientation of the putter head. A second laser device 45 may be placed on the opposite side of the system for left-handed golfers or to reflect off a rear portion of the club head. Reflective surfaces may optionally be added to the golf club head if the club head itself does not adequately reflect the incident laser beams.

The system further includes a force plate 70 operatively coupled to the computer and positioned under the striking location such that the golfer will stand atop it when addressing the ball. The force plate 70 preferably is positioned beneath the putting surface 16 such that it is not visible to the golfer. For example, the force plate 70 can be positioned in a hole in a floor such that the top surface of the force plate 70 is coplanar with the floor. Artificial turf or other material may then be placed atop the floor and force plate 70 to form the artificial putting surface 16. The force plate 70 should be large enough to accommodate both right- and left-handed golfers.

Figure 10:
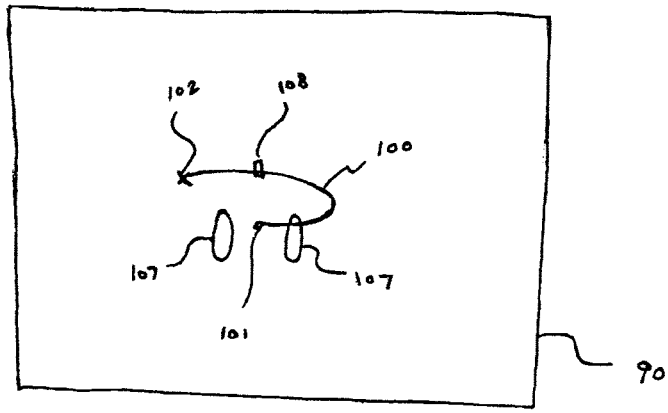
FIG. 10 is a display of a dynamic center of weight trace.

The force plate 70 measures the golfer's center of weight as it shifts and moves during the swing and transmits this dynamic center of weight data to the computer. The computer analyzes the data and, if configured to do so by the operator, transmits this information to the display. FIG. 10 shows a display 90 of a dynamic center of weight trace 100 as a function of time. Indicia are used to indicate the beginning and ending of the trace 100. In the illustrated embodiment, the start 101 of the trace 100 is indicated with a small circle and the end 102 of the trace 100 is indicated with an X. Color coding may also be used. For example, the start indicator may be colored green, and the end indicator may be colored red. Other indicia may also be used to facilitate interpretation of the data. For example, indicia 107 represent the golfer's feet and indicator 108 represents the ball location. Thus, in the illustrated example it is seen that the golfer's weight was initially centered between the feet at address, shifted rearward during the backswing, and then shifted forward during the swing and follow-through. It is also seen that the golfer's center of weight shifted forward during the swing. This information may help explain other measurements, such as why the golfer has an outside-in swing path. The dynamic center of weight data captured via the force plate 70 can be used in conjunction with captured image data to confirm what is taking place during the golfer's swing. For example, capturing and showing the golfer dynamic center of weight data simultaneously with video images taken of the golfer's head during the swing will put into perspective the effect of the golfer's head movement or "slide" during the golf swing. Video images of other portions of the golfer's body (shoulders, knees, etc.) may also be used, in conjunction with or instead of images of the golfer's head.

Figure 11:
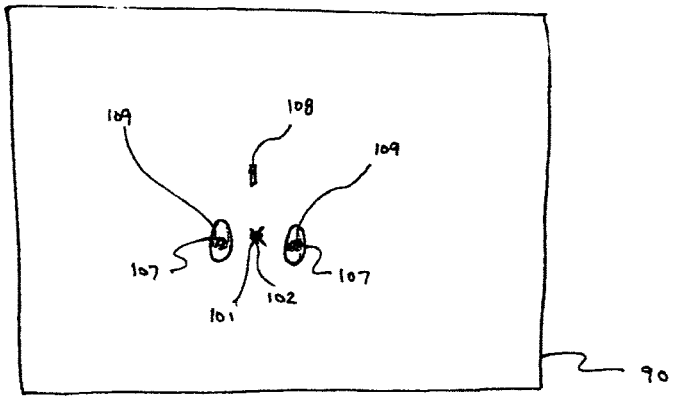
FIG. 11 shows a second display of a dynamic center of weight trace.

FIG. 11 shows a measurement of a golfer's center of weight when using proper alignment during a putting stoke. The golfer's weight remains centered between the golfer's feet before, during, and after the swing. The golfer's center of gravity is between his feet, at approximately the middle of his feet. This allows the golf swing to begin on the proper swing path, which allows the down swing and follow through to be on the proper swing path. As a result, the start and end indicia are overlapped, and there is no visible trace 100.

The force plate 70 can also be used to determine and confirm whether the golfer is using a putter (or other golf club) with the correct shaft length. If the shaft is too short, the golfer's weight will likely be shifted forward to the toes. This will likely cause the golfer's swing to be off-plane, resulting in a pushed/pulled or sliced/hooked golf swing and an undesired golf shot. Similarly, a centering of the golfer's weight over his heels may be an indication that the putter shaft is too long, which also frequently results in an undesired swing and ball path. In addition to showing the golfer's overall center of gravity, the weight distribution on each of the golfer's feet can also be shown. In other words, the force plate 70 can be configured to statically and/or dynamically measure the pressure applied by each of the golfer's feet and where such pressure is centered on each of the golfer's feet during the swing. This pressure data is transferred to the computer where it can be analyzed and/or transmitted to a display. This pressure data can be displayed simultaneously with other data captured by the system. The pressure data can be displayed in various forms. For example, the feet indicia 107 in the display of FIG. 11 include indicia 109 that show that the golfer's weight is properly positioned in the middle of each foot. In the illustrated embodiment, the portions of the feet indicia 107 that correspond to the pressure concentrations in the golfer's feet are darkened or colored such that they are readily discernible. These indicia 109 may be color coded such that the more intense the concentration (for example, the further away from ideal the concentrations are), the more intense the indicia are. If the concentrations are ideal a pleasing color such as green may be used, but if the concentrations are far from ideal a harsher color such as red may be used. It should be noted that while in the illustrated example the golfer's weight is centered in the same general location of each foot, this is not necessarily the case. As discussed above, the system of the present invention can be used to determine exactly what the golfer is doing during the swing and to identify any problems with or undesirable characteristics of the swing. The addition of the strike plate further allows the system operator to determine why certain swing flaws are occurring. Providing a golfer with the correct shaft length allows the golfer properly to distribute his weight and to set the position of the hands, shoulders, and eyes, allowing for a desired golf swing and a golf shot. The force plate 70 allows the operator to confirm the measurements made using other aspects of the system.

A second monitor 36 may preferably be included with the system. The monitor 36 may take any desired form, such as a liquid crystal display (LCD) or a plasma screen. The second monitor preferably is positioned such that the golfer can easily see it while addressing the golf ball 12 in the striking location. The outline of monitor 36 is shown in FIG. 9 by broken lines to indicate a preferred position. In this manner, the golfer will be able to quickly receive feedback without having to leave the putting surface 16. This benefit is increased if the computer is configured to simultaneously transfer and display different sets of data to the display(s). This may allow the golfer to see both the cause and effect of shot irregularities. For example, the display can be divided into four areas with ball side view image data from camera 20 being displayed in a first of the areas, wrist side view image data from camera 24 being displayed in a second of the areas, ball front view image data from camera 28 being displayed in a third of the areas, and center of weight data from force plate 70 being displayed in a fourth of the areas. More or fewer areas can be used, and any desired data representation can be shown in any of the windows.

Figure 12:
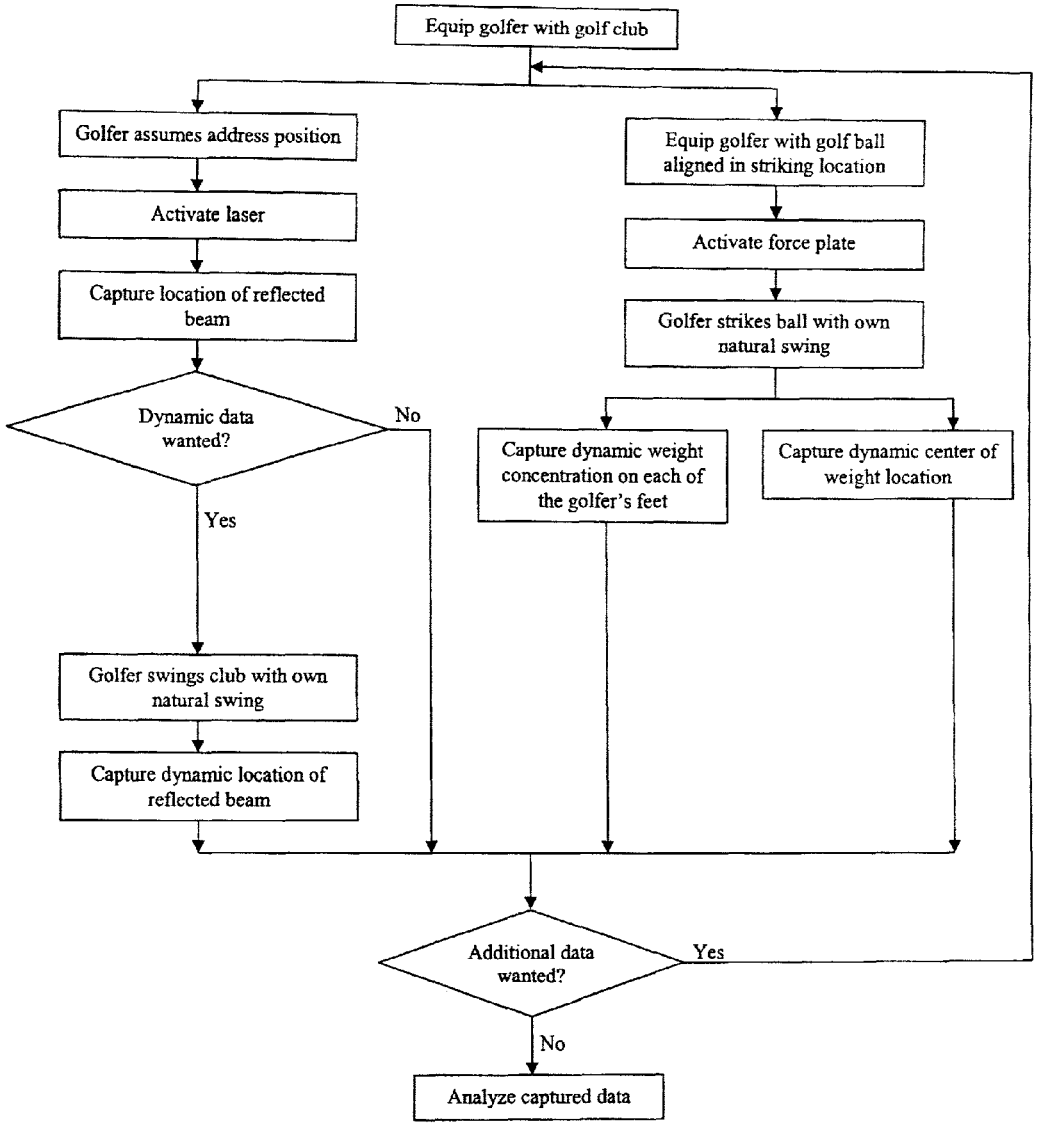
FIG. 12 is a flow chart setting forth exemplary methods of analyzing a golfer's swing.

FIG. 12 is a flow chart setting forth exemplary methods of the invention for analyzing a golfer's swing. The golfer is first provided with a golf club, which may be the preferred golf club described above. The system operator then decides what data to capture and analyze. If the operator chooses to capture data regarding the squareness of the golfer's club head, the operator may opt to use the laser 40. It should be noted that if the laser is to be used, the prior step of providing the golfer with a golf club includes providing a club with a reflective face surface so that the laser beam will be reflected. The golfer assumes the address position at the appropriate location on the putting surface 16, and the operator activates the laser. The laser beam 41 is directed towards and impacts the club face. The operator captures data regarding the location of the reflected laser beam 42, including any amount of deviation from the predetermined location 43. Instead of or in addition to this static information, the operator may decide to capture dynamic data using the laser 40. Should this be the case, the golfer is instructed to swing the golf club with his own natural golf swing, during which the operator captures dynamic information regarding the reflected laser beam 42.

The operator may opt to capture data using the force plate 70. In this instance, the golfer is equipped with a golf ball aligned in the striking location as mentioned above. The operator activates the force plate such that it will collect weight data, and instructs the golfer to strike the golf ball with his own natural golf swing, during which the operator captures dynamic information regarding the golfer's weight. It should be noted that the operator can also capture data prior to and after the golf swing. The operator may choose to capture data regarding the weight distribution on each of the golfer's feet. Alternatively or additionally, the operator may choose to capture data regarding the location of the golfer's center of weight.

The above data capturing sequences are provided by way of example only. More or fewer steps can take place. Additionally, the above and other data capturing sequences, including image capturing sequences, can take place simultaneously. Each data set can be used to confirm or explain the reason for other collected data. For example, if collected image data reveals that the golfer imparts a push and a slicing spin to the putt, data collected using the laser 40 may reveal and explain that the golfer has an open club face posture when striking the golf ball and/or data collected using the force plate may reveal and explain that the golfer's putter shaft is too long.

One skilled in the art will appreciate that, once golfer 10's putting stroke has been analyzed, and once golfer 10 has been custom fit with a putter based upon this analysis, steps 50 through 62 (as shown in FIG. 2) may again be followed—this time using the custom-fit putter as the putter of known dimensions discussed in conjunction with step 50. By re-analyzing the golfer's putting stroke in this fashion, it may be determined whether the custom fit putter is providing golfer 10, as expected, with desirable swing results.

While the preferred embodiments of the present invention have been described above, it should be understood that they have been presented by way of example only, and not of limitation. It will be apparent to persons skilled in the relevant art that various changes in form and detail can be made therein without departing from the spirit and scope of the invention. Thus the present invention should not be limited by the above-described exemplary embodiments, but should be defined only in accordance with the following claims and their equivalents. Furthermore, while certain advantages of the invention have been described herein, it is to be understood that not necessarily all such advantages may be achieved in accordance with any particular embodiment of the invention. Thus, for example, those skilled in the art will recognize that the invention may be embodied or carried out in a manner that achieves or optimizes one advantage or group of advantages as taught herein without necessarily achieving other advantages as may be taught or suggested herein.

What is claimed is:

1. A golf analysis system for analyzing a golfer's swing, comprising:

a striking location to accommodate a golf ball to be struck with a golf club, wherein the golf club comprises a grip portion and a head, and wherein the golf ball comprises markers;

a first camera directed at said striking location and positioned to capture side view images of the ball;

a second camera operatively coupled to a computer and positioned to capture top view images of the golfer, the club, and the ball during the swing;

a third camera directed at said striking location and positioned to capture front view images of the ball before and after being struck by the club;

a force plate positioned such that the golfer will stand atop the force plate when addressing the golf ball;

a computer operatively coupled to said first, second, and third cameras and said force plate, said computer including:

memory for storing data received from said first, second, and third cameras and said force plate; and analyzing software for analyzing data supplied to said computer, wherein the data comprises ball movement data from images captured by at least one of the first, second, and third cameras; and a first display operatively coupled to said computer.

2. The golf analysis system of claim 1, further comprising:

a fourth camera operatively coupled to said computer and positioned to capture side view images of the golfer's shoulders during the swing; and a fifth camera operatively coupled to said computer and positioned to capture front view images of the golfer's shoulders during the swing.

3. The golf analysis system of claim 2, further comprising:
a sixth camera operatively coupled to said computer and positioned to capture rear view images of the club head during the swing.

4. The golf analysis system of claim 1, wherein said first, second, and third cameras are high-speed video cameras.

5. The golf analysis system of claim 1, wherein said force plate is configured to dynamically measure the location of the golfer's center of weight during the swing and to transfer such measured center of weight data to said computer.

6. The golf analysis system of claim 5, wherein said computer is configured to analyze and transfer said center of weight data to said first display such that the golfer's dynamic center of weight is displayed.

7. The golf analysis system of claim 6, wherein said dynamic center of weight is displayed as a trace as a function of time.

8. The golf analysis system of claim 6, wherein said computer is configured to analyze and transfer image data and said center of weight data to said first display such that image data of the golfer, club, and ball during the swing and the golfer's dynamic center of weight are displayed simultaneously.

9. The golf analysis system of claim 8, further comprising a second display positioned to be viewable by the golfer at address, operatively coupled to said computer, and configured to display the same information as said first display.

10. The golf analysis system of claim 6, wherein said force plate is further configured to dynamically measure the pressure applied by each of the golfer's feet and where such pressure is centered on each of the golfer's feet during the swing and to transfer such measured pressure data to said computer.

11. The golf analysis system of claim 10, wherein said computer is configured to analyze and transfer image data, said center of weight data, and said pressure data to said first display such that image data of the golfer, club, and ball during the swing and the golfer's dynamic center of weight and dynamic foot pressure are displayed simultaneously.

12. The golf analysis system of claim 1, further comprising a rail positioned on said striking location so as to be intermediate the golfer's feet and the golf ball.

13. The golf analysis system of claim 1, wherein said rail includes measurement indicia thereon.

14. The golf analysis system of claim 1, further comprising a laser device positioned in front of the golfer and oriented to project a laser beam at the club head such that said laser beam will be reflected onto a predetermined location when the golf club is properly positioned at address.

15. A golf analysis system for analyzing a golfer's swing, comprising:
a striking location to accommodate the golfer, a golf club, and a golf ball to be struck with the golf club, wherein the golf club comprises a grip portion and a head, and wherein the golf ball comprises markers;
a first camera directed at said striking location and positioned to capture side view images of the club head;
a second camera directed at said striking location and positioned to capture back view images of the club head;
a third camera directed at said striking location and positioned to capture front view images of the ball before and after being struck by the club;
a force plate positioned such that the golfer will stand atop the force plate when addressing the golf ball;
a rail positioned on said striking location so as to be intermediate the golfer's feet and the golf ball;
a computer operatively coupled to said first, second, and third cameras and the force plate, said computer including:
memory for storing data received from said first, second, and third cameras and the force plate; and
analyzing software for analyzing data supplied to said computer, wherein the data comprises ball movement data from images captured by the third camera;
a first display operatively coupled to said computer.

16. The golf analysis system of claim 15, further comprising a laser device positioned behind the golfer and oriented to project a laser beam at the club head such that said laser beam will be reflected onto a predetermined location when the golf club is properly positioned at address.

17. The golf analysis system of claim 1, wherein the markers comprise bands placed along two perpendicular circumferences of the golf ball.

18. The golf analysis system of claim 15, wherein the markers comprise bands placed along two perpendicular circumferences of the golf ball.

* * * * *